US010553156B2

(12) United States Patent
Yeo et al.

(10) Patent No.: US 10,553,156 B2
(45) Date of Patent: Feb. 4, 2020

(54) DISPLAY DEVICE INCLUDING COMPENSATION

(71) Applicant: Samsung Display Co., Ltd., Yongin-si, Gyeonggi-do (KR)

(72) Inventors: Sang Jae Yeo, Yongin-si (KR); Wook Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/162,105

(22) Filed: Oct. 16, 2018

(65) Prior Publication Data

US 2019/0164484 A1 May 30, 2019

(30) Foreign Application Priority Data

Nov. 29, 2017 (KR) ..... 10-2017-0161867

(51) Int. Cl.

*G09G 3/32* (2016.01)
*G09G 3/3233* (2016.01)
*G09G 3/3291* (2016.01)
*G09G 3/3266* (2016.01)

(52) U.S. Cl.

CPC ..... *G09G 3/3233* (2013.01); *G09G 3/3291* (2013.01); *G09G 3/3266* (2013.01); *G09G 2300/0426* (2013.01); *G09G 2310/08* (2013.01)

(58) Field of Classification Search

CPC ..... G09G 3/3233; G09G 2320/0295; G09G 2320/043; G09G 2320/045; G09G 3/3291; G09G 2330/12; G09G 2320/0233; G09G 3/3258; G09G 3/006; G09G 2300/0866; G09G 2320/0693; G09G 2330/021; G09G 2330/02; G09G 3/3266; G09G 2310/08; G09G 2300/0426; G09G 2320/0285; G09G 2310/0251; G09G 2300/0861; G09G 2300/0842; G09G 2300/0819

USPC ..... 345/211, 212, 690

See application file for complete search history.

(56) References Cited

U.S. PATENT DOCUMENTS

2004/0108518 A1* 6/2004 Jo ..... G09G 3/006 257/200
2011/0227505 A1* 9/2011 Park ..... H05B 33/0896 315/297
2017/0047017 A1* 2/2017 Shirouzu ..... G09G 3/325
2019/0130835 A1 5/2019 Ka et al.

FOREIGN PATENT DOCUMENTS

KR 10-2015-0125155 A 11/2015
KR 10-2019-0049995 A 5/2019

* cited by examiner

*Primary Examiner* — Duc Q Dinh
(74) *Attorney, Agent, or Firm* — Lewis Roca Rothgerber Christie LLP

(57) ABSTRACT

A display device includes: a first pixel row including n pixels coupled to a first scan line; a second pixel row including m pixels coupled to a second scan line; a first power voltage source for supplying a first power voltage to the pixels of the first pixel row and the second pixel row through a first power voltage line; a current sensor for sensing a value of a line current flowing between the first power voltage line and a selected pixel row among the first pixel row and the second pixel row; and a timing controller for calculating a converted current value of the selected pixel row, wherein n is a natural number, and m is a natural number greater than n.

18 Claims, 8 Drawing Sheets

DISPLAY DEVICE INCLUDING COMPENSATION

CROSS-REFERENCE TO RELATED APPLICATION

This application claims priority to and the benefit of Korean patent application 10-2017-0161867 filed on Nov. 29, 2017 in the Korean Intellectual Property Office, the entire disclosure of which is incorporated herein by reference.

BACKGROUND

1. Field

An aspect of the present disclosure relates to a display device.

2. Related Art

With the development of information technologies, the importance of a display device which is a connection medium between a user and information increases. Accordingly, display devices such as a liquid crystal display device, an organic light emitting display device, and a plasma display panel are increasingly used.

Organic light emitting display devices display images using an organic light emitting diode that generates light by recombination of electrons and holes. The organic light emitting display device may have a high response speed and may be driven with low power consumption.

However, due to manufacturing deviations in transistors of pixels, load mismatch caused by a pixel position, and the like, the pixels of a display may emit lights with different luminances for the same data signal.

The above information disclosed in this Background section is only for enhancement of understanding of the background of the invention, and therefore it may contain information that does not form the prior art that is already known to a person of ordinary skill in the art.

SUMMARY

Embodiments provide a display device capable of compensating for a difference in luminance between pixel rows including different numbers of pixels.

According to an aspect of the present disclosure, there is provided a display device including: a first pixel row including n pixels coupled to a first scan line; a second pixel row including m pixels coupled to a second scan line; a first power voltage source configured to supply a first power voltage to the pixels of the first pixel row and the second pixel row through a first power voltage line; a current sensor configured to sense a value of a line current flowing between the first power voltage line and a selected pixel row among the first pixel row and the second pixel row; and a timing controller configured to calculate a converted current value of the selected pixel row, wherein n is a natural number, and m is a natural number greater than n.

The converted current value may be calculated by dividing the value of the line current by the number of pixels included in the selected pixel row.

The pixels of the first pixel row and the second pixel row may be coupled to the first power voltage line through a common node.

The display device may further include a second power voltage source configured to supply a second power voltage to the pixels of the first pixel row and the second pixel row through a second power voltage line.

The first power voltage may have a voltage value higher than that of the second power voltage.

The first power voltage may have a voltage value lower than that of the second power voltage.

The pixels of the first pixel row may be coupled to the first power voltage line through a first switch, and the pixels of the second pixel row may be coupled to the first power voltage line through a second switch.

The display device may further include a second power voltage source configured to supply a second power voltage to the pixels of the first pixel row and the second pixel row through a second power voltage line.

The first power voltage may have a voltage value higher than that of the second power voltage.

The first power voltage may have a voltage value lower than that of the second power voltage.

The display device may further include: a first scan driver configured to supply a scan signal through the first scan line and the second scan line; and a data driver configured to supply a test data signal to the pixels of the first pixel row and the second pixel row through a plurality of data lines. The current sensor may sense the value of line current flowing between the first power voltage line and a pixel row selected by the scan signal and the test data signal.

The timing controller may calculate data signal gain values which when multiplied by the converted current values for the first and second pixel rows result in an equal value for the first pixel row and the second pixel row.

The display device may further include a look-up table configured to record the data signal gain values.

The timing controller may provide the data driver with a compensated image signal obtained by compensating for an input image signal for each pixel row using the data signal gain values.

The current sensor may be coupled to a closed switch among the first switch and the second switch to sense a value of line current flowing between a selected pixel row and the first power voltage line.

The timing controller may calculate data signal gain values which when multiplied by the converted current values for the first and second pixel rows result in an equal value for the first pixel row and the second pixel row.

The display device may further include a look-up table configured to record the data signal gain values.

The timing controller may provide the data driver with a compensated image signal obtained by compensating for an input image signal for each pixel row using the data signal gain values.

BRIEF DESCRIPTION OF THE DRAWINGS

Example embodiments will now be described more fully hereinafter with reference to the accompanying drawings; however, embodiments according to the present disclosure may be embodied in different forms and should not be construed as limited to the embodiments set forth herein. Rather, these embodiments are provided so that this disclosure will be thorough and complete, and will fully convey the scope of the example embodiments to those skilled in the art.

In the figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
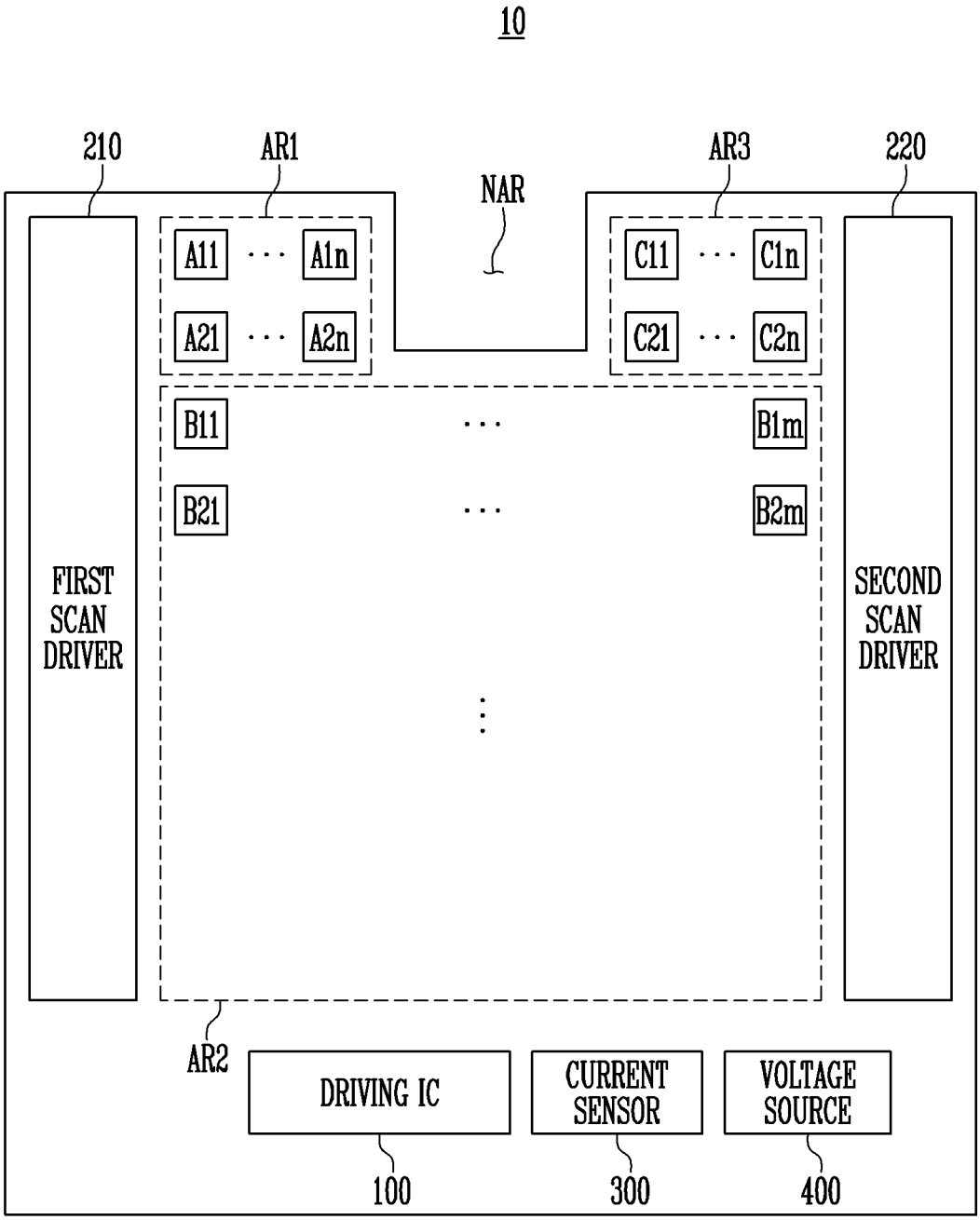
FIG. 1 is a diagram illustrating a display device according to an embodiment of the present disclosure.

Hereinafter, exemplary embodiments are described in detail with reference to the accompanying drawings so that those skilled in the art may easily practice the present disclosure. The present disclosure may be implemented in various different forms and is not limited to the exemplary embodiments described in the present specification.

The same or similar constituent elements may be designated by the same reference numerals throughout the specification. Therefore, the same reference numerals may be used in different drawings to identify the same or similar elements.

In addition, the size and thickness of each component illustrated in the drawings may be arbitrarily shown for better understanding and ease of description, but the present disclosure is not limited thereto. Thicknesses of several portions and regions may be exaggerated for clear expressions.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

FIG. 1 is a diagram illustrating a display device according to an embodiment of the present disclosure.

Referring to FIG. 1, the display device 10 according to the embodiment of the present disclosure includes a driving integrated circuit (IC) 100, first and second scan drivers 210 and 220, a current sensor 300, a voltage source 400, and display areas AR1, AR2, and AR3.

The display device 10 of the present disclosure may include three display areas AR1, AR2, and AR3 so as to secure a notch area NAR for installing a camera, etc. A first display area AR1 may be located at a left side of the notch area NAR, a second display area AR2 may be located at a lower end of the notch area NAR, and a third display area AR3 may be located at a right side of the notch area NAR.

In this embodiment, the notch area NAR is located at an upper side of the display device 10. However, in another embodiment, the notch area may be located at various positions such as a right side, a left side, a lower side, and a portion of the center of the display device.

The first display area AR1 includes a plurality of pixel rows. Each pixel row includes n pixels coupled to the same scan line. Here, n is a natural number. For example, a first pixel row may include n pixels A11 to A1*n*, and a second pixel row may include n pixels A21 to A2*n*. In this embodiment, for convenience of description, a case where the first display area AR1 includes two pixel rows is illustrated as an example. However, in other embodiments, a larger number of pixel rows may be included according to the size of the first display area AR1.

The second display area AR2 includes a plurality of pixel rows. Each pixel row includes m pixels coupled to the same scan line. Here, m is a natural number greater than n. For example, a first pixel row may include m pixels B11 to B1*m*, and a second pixel row may include m pixels B21 to B2*m*). Each of the other pixel rows may also include m pixels in the same manner.

A third display area AR3 includes a plurality of pixel rows. Each pixel row includes n pixels coupled to the same scan line. Here, n is a natural number. For example, a first pixel row may include n pixels C11 to C1*n*, and a second pixel row may include n pixels C21 to C2*n*. In this embodiment, for convenience of description, a case where the third pixel area AR3 includes two pixel rows is illustrated as an example. However, in other embodiments, a larger number of pixel rows may be included according to the size of the third display area AR3.

In this embodiment, it is assumed that each pixel row of the first display area AR1 and each pixel row of the third display area AR3 include the same number of pixels (e.g., n pixels). However, in other embodiments, the number of pixels included in each pixel row of the first display area AR1 may be different from that of pixels included in each pixel row of the third display area AR3.

The driving IC 100 receives an image signal and a control signal from an external application processor (AP), etc., and generates an image signal and a control signal, which are obtained by converting the received image signal and control signal suitable for specifications of the display device 10. For example, the driving IC 100 may supply a plurality of clock signals, a scan start pulse, and the like to a first scan driver 210 and a second scan driver 220. Also, for example, the driving IC 100 may supply a plurality of data signals to a plurality of corresponding data lines, corresponding to a scan signal to be supplied to the scan drivers 210 and 220. The coupling relationship between the internal structure of the driving IC 100 and the display areas AR1, AR2, and AR3 will be described later with reference to FIG. 2 and subsequent figures.

The first scan driver 210 may include a plurality of scan stage circuits. The plurality of scan stage circuits may be coupled to a plurality of scan lines extending to the first display area AR1 and the second display area AR2. For example, the first scan driver 210 may sequentially supply scan signals having a turn-on level to the first display area AR1 and the second display area AR2 (e.g., in the form of a shift register). A first scan stage circuit of the first scan driver 210 may supply a scan signal having the turn-on level to a corresponding scan line according to the scan start pulse and the plurality of clock signals, which are supplied from the driving IC 100. Each of the other scan stage circuits from a second scan stage circuit of the first scan driver 210 may receive the scan signal having the turn-on level, which is supplied from the first scan stage circuit, as the scan start pulse (and/or each scan stage circuit after the first scan stage circuit may receive the scan signal having the turn-on level of the previous scan stage as the scan start pulse), and supply the scan signal having the turn-on level to a corresponding scan line under the control of the plurality of clock signals. A pixel included in a pixel row receiving the scan signal having the turn-on level may receive a data signal from the driving IC 100. The structure of a pixel will be described later with reference to FIG. 3.

The second scan driver 220 may include a plurality of scan stage circuits. The plurality of scan stage circuits may be coupled to a plurality of scan lines extending to the third display area AR3 and the second display area AR2. For example, the second scan driver 220 may sequentially supply scan signals having the turn-on level to the third display area AR3 and the second display area AR2 (e.g., in the form of a shift register). A first scan stage circuit of the second scan driver 220 may supply a scan signal having the turn-on level to a corresponding scan line according to the scan start pulse and the plurality of clock signals, which are supplied from the driving IC 100. Each of the other scan stage circuits from a second scan stage circuit of the second scan driver 220 may receive the scan signal having the turn-on level, which is supplied from the first scan stage circuit, as the scan start pulse (and/or each scan stage circuit after the first scan stage circuit may receive the scan signal having the turn-on level of the previous scan stage as the scan start pulse), and supply the scan signal having the turn-on level to a corresponding scan line under the control of the plurality of clock signals. A pixel included in a pixel row receiving the scan signal having the turn-on level may receive a data signal from the driving IC 100.

The voltage source 400 supplies a power voltage to each of the display areas AR1, AR2, and AR3 through a power voltage line. The coupling relationship between the voltage source 400 and the display areas AR1, AR2, and AR3 will be described later with reference to FIG. 2 and subsequent figures.

The current sensor 300 may sense a current flowing in the power voltage line. Some embodiments of the current sensor 300 will be described later with reference to FIG. 2 and subsequent figures.

Figure 2:
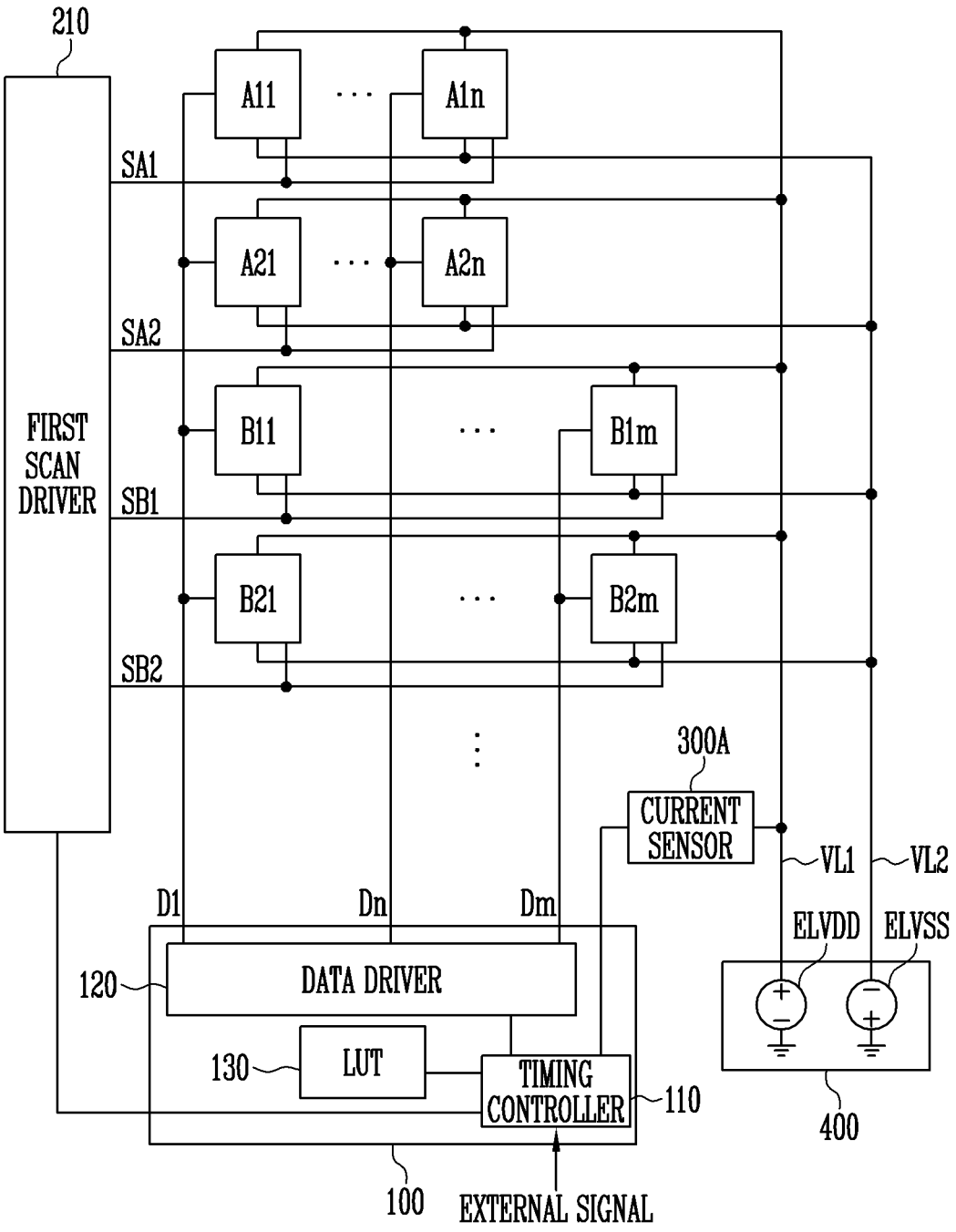
FIG. 2 is a diagram illustrating a display device including a current sensor according to a first embodiment of the present disclosure.

In FIG. 2 and subsequent figures, for convenience of description, a structure and a compensation method are applied based on the first display area AR1 and the second display area AR2. However, it will be apparent that the same structure and compensation method may also be applied to the third display area AR3 and the second display area AR2.

Figure 3:
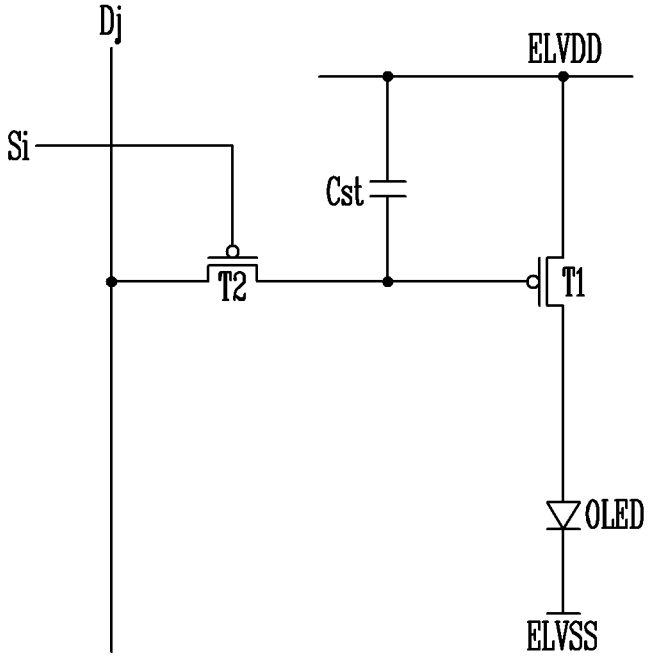
FIG. 3 is a diagram illustrating a pixel according to an embodiment of the present disclosure.

FIG. 2 is a diagram illustrating the display device including a current sensor according to a first embodiment of the present disclosure. FIG. 3 is a diagram illustrating a pixel according to an embodiment of the present disclosure.

Each pixel row of the first display area AR1 includes n pixels coupled to a fist scan line. For example, n pixels A11 to A1*n* are coupled to a first scan line SA1, and n pixels A21 to A2*n* are coupled to a first scan line SA2.

Each pixel row of the second display area AR2 includes m pixels coupled to a second scan line. For example, m pixels B11 to B1*m* are coupled to a second scan line SB1, and m pixels B21 to B2*m* are coupled to a second scan line SB2.

Referring to FIG. 3, the structure of an exemplary pixel of each of the display areas AR1, AR2, and AR3 is illustrated. The pixel may include a plurality of transistors T1 and T2, a storage capacitor Cst, and an organic light emitting diode OLED. In this embodiment, the transistors T1 and T2 may be P-type transistors. However, it will be understood by those skilled in the art that a pixel circuit having the same function may be configured using N-type transistors.

A gate terminal of the transistor T2 is coupled to a scan line Si, one end of the transistor T2 is coupled to a data line Dj, and the other end of the transistor T2 is coupled to a gate terminal of the transistor T1.

The gate terminal of the transistor T1 is coupled to the other end of the transistor T2, one end of the transistor T1 is coupled to a first power voltage source ELVDD, and the other end of the transistor T1 is coupled to an anode of the organic light emitting diode OLED.

The storage capacitor Cst couples the one end and the gate terminal of the transistor T1.

The anode of the organic light emitting diode OLED is coupled to the other end of the transistor T1, and a cathode of the storage capacitor Cst is coupled to a second power voltage source ELVSS.

If a scan signal having the turn-on level is supplied to the gate terminal of the transistor T2 through the scan line Si, the transistor T2 allows the data line Dj and one end of the storage capacitor Cst to be electrically coupled to each other. Thus, a voltage value corresponding to the difference between the voltage of a data signal applied through the data line Dj and a first power voltage is written in the storage capacitor Cst. The transistor T1 allows a driving current determined based on the voltage value written in the storage capacitor Cst to flow from the first power voltage source ELVDD to the second power voltage source ELVSS. The organic light emitting diode OLED emits light with a luminance corresponding to an amount of the driving current.

Referring back to FIG. 2, the first power voltage source ELVDD supplies the first power voltage to each pixel through a first power voltage line VL1. The second power voltage source ELVSS supplies a second power voltage to each pixel through a second power voltage line VL2. In this embodiment, the first power voltage has a voltage value higher than that of the second power voltage.

The driving IC 100 may include a timing controller 110, a data driver 120, and a look-up table (LUT) 130. As described with reference to FIG. 1, the timing controller 110 receives an external signal including an image signal and a control signal from an external AP, etc., and generates an image signal and a control signal, which are obtained by converting the received external signal to be suitable for specifications of the display device 10.

The timing controller 110 may supply the control signal to the first scan driver 210 and supply the image signal and the control signal to the data driver 120. At this time, the timing controller 110 may supply, to the data driver 120, a compensated image signal compensated in units of pixel rows, using a data signal gain value recorded in the look-up table 130. The data signal gain value to be recorded in the look-up table 130 may be generated in a factory phase, and this procedure will be described in detail later. The data driver 120 may supply a data signal generated using the compensated image signal received from the timing controller 110 to pixels through each of data lines D1 to Dn to Dm.

In this embodiment, a current sensor 300A senses current flowing in the first power voltage line VL1. The current sensor 300A, in the factory phase (e.g., at the time of or shortly after manufacturing), may be used to generate the data signal gain value to be recorded in the look-up table 130.

Hereinafter, the factory phase for generating the data signal gain value to be recorded in the look-up table 130 will be described. As used herein, a factory phase may refer to the time of manufacturing, the time shortly after manufacturing, or another period during which the display device can be configured before use.

In this embodiment, the first scan driver 210 may supply a scan signal through the first scan lines SA1 and SA2 and the second scan lines SB1 and SB2, and the data driver 120 may supply a test data signal to each pixel through each of the data lines D1 to Dn to Dm.

The current sensor 300A may sense a value of line current flowing between a pixel row selected by the scan signal and the test data signal and the first power voltage line VL1.

For example, in order to sense a value of line current flowing in the pixel row A21 to A2*n*, the data driver 120 may supply the test data signal to data lines D1 to Dn in a period in which the scan signal having the turn-on level is supplied through the first scan line SA2. At this time, the data driver 120 may not supply the test data signal to the data lines in a period in which the scan signal having the turn-on level is supplied through another scan line (for example, SA1, SB1, SB2, etc.). Therefore, a current flow may be generated with respect to only the pixel row A21 to A2*n*. In this case, a selected pixel row is the pixel row A21 to A2*n*.

The current sensor 300A senses a value of line current flowing between the selected pixel row A21 to A2*n* and the first power voltage line VL1. The timing controller 110 may calculate a converted current value of the selected pixel row A21 to A2*n* by dividing the value of line current sensed by the number n of pixels included in the selected pixel row A21 to A2*n*.

In the same manner, a converted current value of each of the other pixel rows may be calculated. For example, when the selected pixel row is a pixel row B11 to B1*m*, a converted current value of the selected pixel row B11 to B1*m* may be calculated by dividing the value of line current detected by m.

When converted current values of all pixel rows are acquired, the timing controller 110 may record, in the look-up table 130, a data signal gain value (e.g., for each pixel row) at which the converted current values become equal.

For example, in an ideal display device, converted current values of all pixel rows are equal regardless of the number of pixels. However, in an actual display device, converted current values of pixel rows may be different from one another due to load mismatch, IR drop, manufacturing deviation, etc. Thus, as the data signal gain value at which the converted current values (e.g., for each pixel row) become equal is used, it is possible to prevent a case where there occurs a difference in luminance (e.g., between pixel rows) with respect to the same gray scale when a user uses the display device 10.

For example, when the converted current value of the pixel row A21 to A2*n* is 1, the converted current value of the pixel row B11 to B1*m* may be 1.2 with respect to the same test data signal. In such a case, the data signal gain value of the pixel row A21 to A2*n* may be recorded as 1.2 in the look-up table 130, and the data signal gain value of the pixel row B11 to B1*m* may be recorded as 1 in the look-up table 130. Therefore, when a user uses the display device 10, the timing controller 110 may provide a compensated image signal to the data driver 120 such that the data signal for the pixel row A21 to A2*n* is compensated as a value multiplied by 1.2. Also, the timing controller 110 may supply a compensated image signal to the data driver such that the data signal for the pixel row B11 to B1*m* is compensated as a value multiplied by 1, i.e., such that the data signal is provided as the original data signal.

According to the above-described embodiment, the timing controller 110 can provide the data driver 120 with a compensated image signal obtained by compensating for an input image signal for each pixel row, using a data signal gain value.

In another embodiment, the look-up table 130 may store a data signal gain value for each pixel, instead of the data signal gain value for each pixel row. For example, in the factory phase, the data driver 120 does not supply the test data signal to all pixels of a pixel row to be selected but may supply the test data signal to only a specific pixel of the pixel row to be selected. In this case, a current flow is generated only between the selected specific pixel and the first power line VL1 (e.g., the first power voltage ELVDD), and therefore, a converted current value of the selected specific pixel may be directly evaluated when the current sensor 300A uses a measured current value. At this time, since only one specific pixel is selected, a value of line current becomes the converted current value (e.g., without dividing by the number of pixels). In the same manner, individual converted current values of all pixels are evaluated, and a data signal gain value for each pixel at which the all the converted current values become equal may be recorded in the look-up table 130. This embodiment may be applied to the following embodiments of FIGS. 4, 5, and 6, and repeated descriptions will be omitted.

Figure 4:
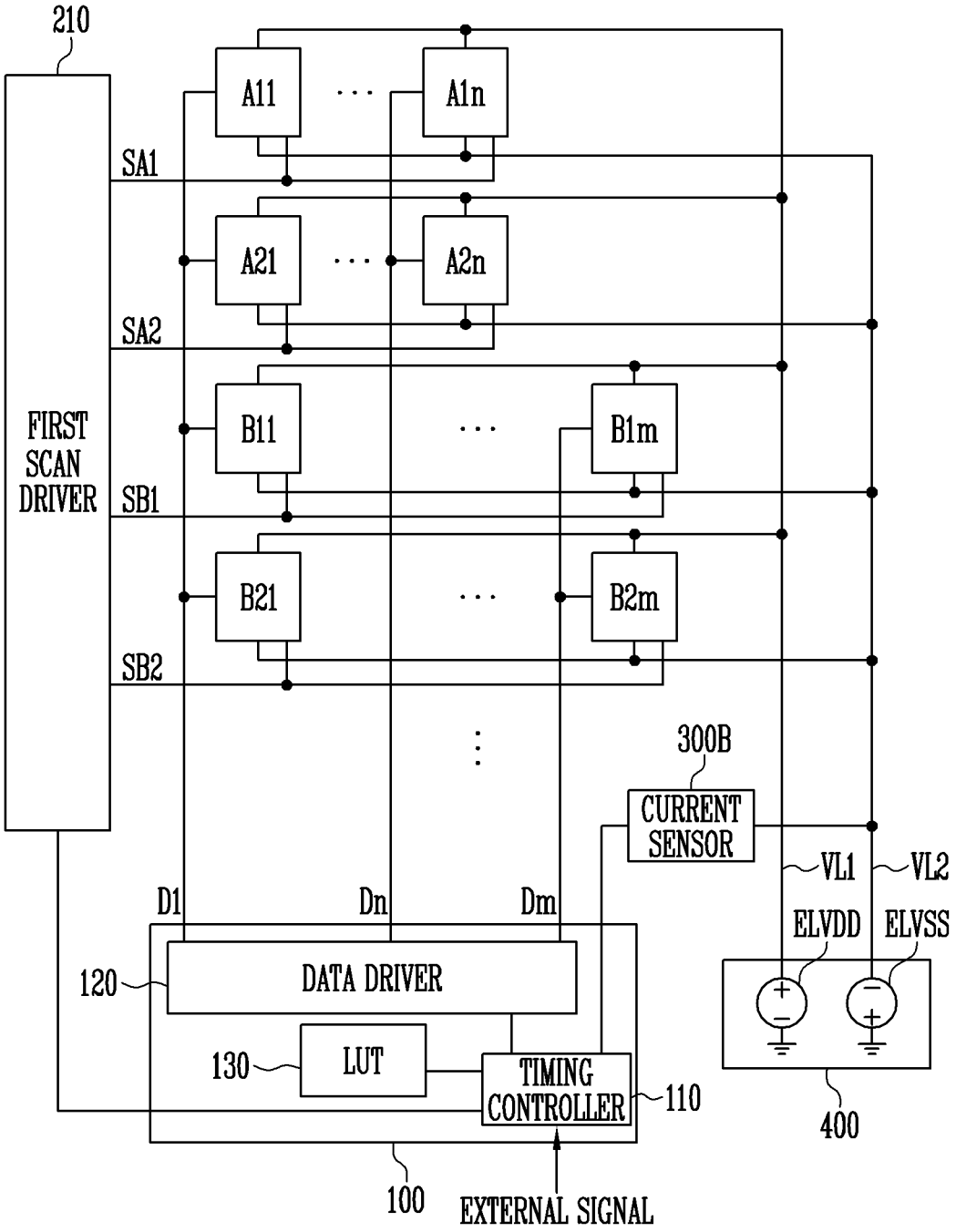
FIG. 4 is a diagram illustrating a display device including a current sensor according to a second embodiment of the present disclosure.

FIG. 4 is a diagram illustrating the display device including a current sensor according to a second embodiment of the present disclosure.

The current sensor 300B of the second embodiment of FIG. 4 is different from the current sensor 300A of the first embodiment of FIG. 3 in that a current flowing in the second power voltage line VL2 is sensed. The other components of the second embodiment of FIG. 4 may be similar or identical to those of the first embodiment of FIG. 3, and therefore, repeated descriptions thereof will be omitted.

Referring to FIG. 3, the first power voltage source ELVDD is electrically coupled to the second power voltage source ELVSS through the organic light emitting diode OLED and the transistor T1, which are interposed therebetween. That is, since a current flows toward the second power voltage source ELVSS from the first power voltage source ELVDD, if the current flows in the first power voltage line VL1, the current also flows in the second power voltage line VL2.

Accordingly, the second embodiment of FIG. 4 is configured such that the current sensor 300B senses a current flowing in the second power voltage line VL2. The value of line current sensed by the current sensor 300B, and the value of line current sensed by the current sensor 300A, may have different polarities (or the same polarity) and may have the same or substantially the same magnitude. In the second embodiment of FIG. 4, a compensation method in the factory phase and a driving method in a user phase (e.g., during use by an end user) may be substantially identical to those described with respect to the first embodiment of FIG. 2, and therefore, their repeated descriptions will be omitted.

Figure 5:
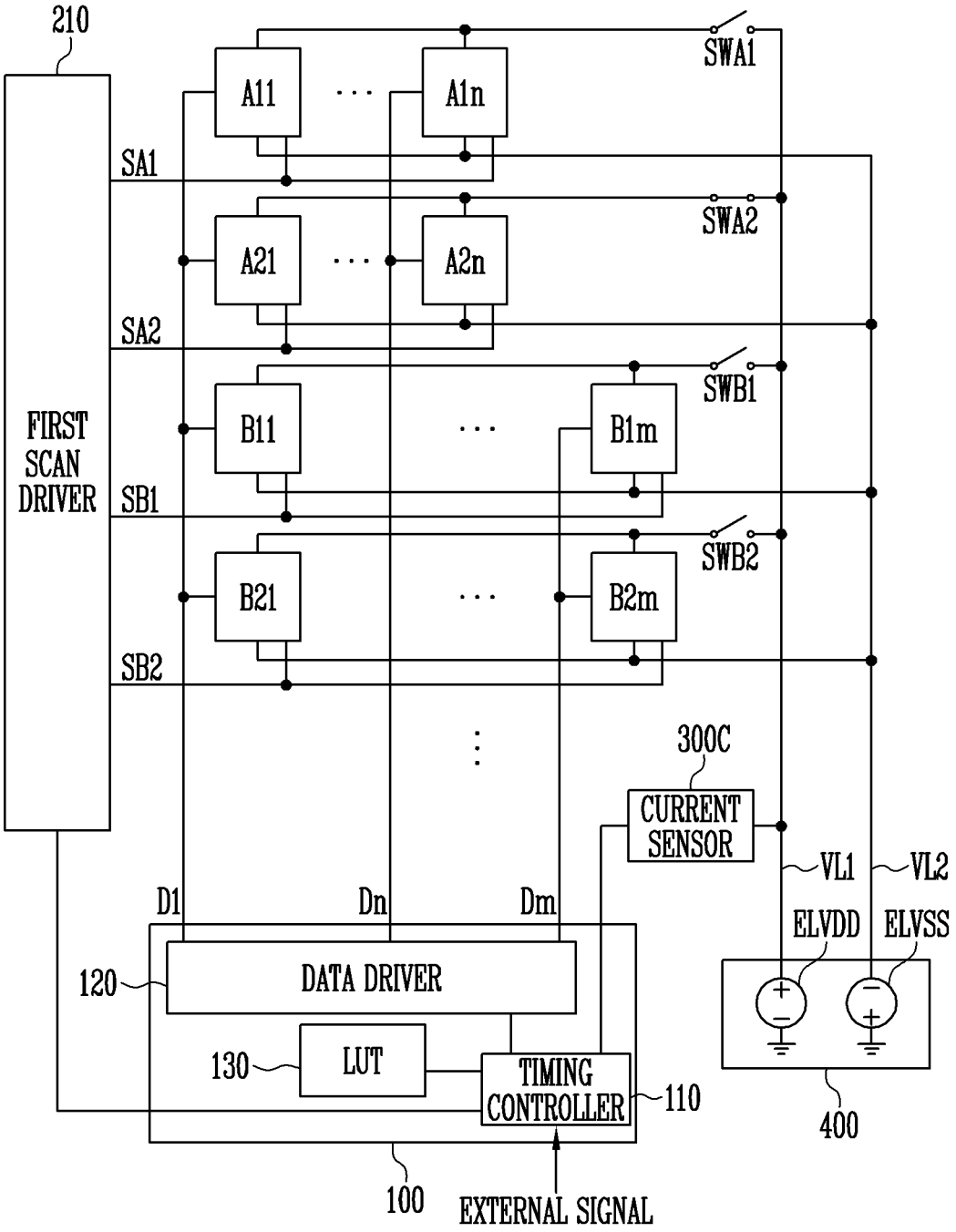
FIG. 5 is a diagram illustrating a display device including a current sensor according to a third embodiment of the present disclosure.

FIG. 5 is a diagram illustrating the display device including a current sensor according to a third embodiment of the present disclosure.

According to the third embodiment of FIG. 5, as compared with the first embodiment of FIG. 2, the display device further includes a plurality of switches SWA1, SWA2, SWB1, SWB2, etc.

Each pixel of the pixel row A1 to A1*n* is coupled to the first power voltage line VL1 through the switch SWA1. Similarly, each pixel of the pixel row A21 to A2*n* is coupled to the first power voltage line VL1 through the switch SWA2, each pixel of the pixel row B11 to B1*m* is coupled to the first power voltage line VL1 through the switch SWB1, and each pixel of the pixel row B21 to B2*m* is coupled to the first power voltage line VL1 through the switch SWB2.

According to the third embodiment of FIG. 5, the method of selecting a pixel row when the compensation method is performed may be different than described above with respect to FIG. 2. In the third embodiment of FIG. 5, the current sensor 300C may be coupled to a pixel line through a turned-on (closed) switch of the plurality of switches SWA1, SWA2, SWB1, SWB2, etc. For example, as illustrated in FIG. 5, the current sensor 300C is coupled to the turned-on switch SWA2 among the plurality of switches SWA1, SWA2, SWB1, SWB2, etc., to sense a value of line current flowing between the selected pixel row A21 to A2*n* and the first power voltage line VL1. At this time, the test data signal is written in each pixel of the pixel row A21 to A2*n* (e.g., the test data signal is applied to each data line D1 to Dn).

According to the third embodiment of FIG. 5, although the test data signal is written in another pixel instead of the pixel of the selected pixel row A21 to A2*n* (e.g., it is applied to each pixel connected to the data line), the other pixel is not supplied with the first power voltage, and therefore, no current flows. Thus, according to this embodiment, it may be possible to more accurately sense a value of line current for the selected pixel row A21 to A2*n*.

Subsequently, similarly to the first embodiment of FIG. 2, the timing controller 110 may calculate a converted current value of the selected pixel row A21 to A2*n* by dividing the value of the line current by the number n of pixels included in the selected pixel row A21 to A2*n*. If converted current values of all the pixel rows are calculated, the timing controller 110 may record, in the look-up table 130, a data signal gain value (e.g., a value for each pixel row) at which the converted current values of all the pixel rows become equal.

When a user uses the display device 10, the timing controller 110 can provide the data driver 120 with a compensated image signal obtained by compensating for an input image signal for each pixel row using a data signal gain value for said pixel row.

In the third embodiment of FIG. 5, as described in the first embodiment of FIG. 2, a data signal gain value for each pixel instead of each pixel row may be recorded in the look-up table 130. This may be implemented by supplying the test data signal to a specific pixel from the data driver 120 as described above.

Figure 6:
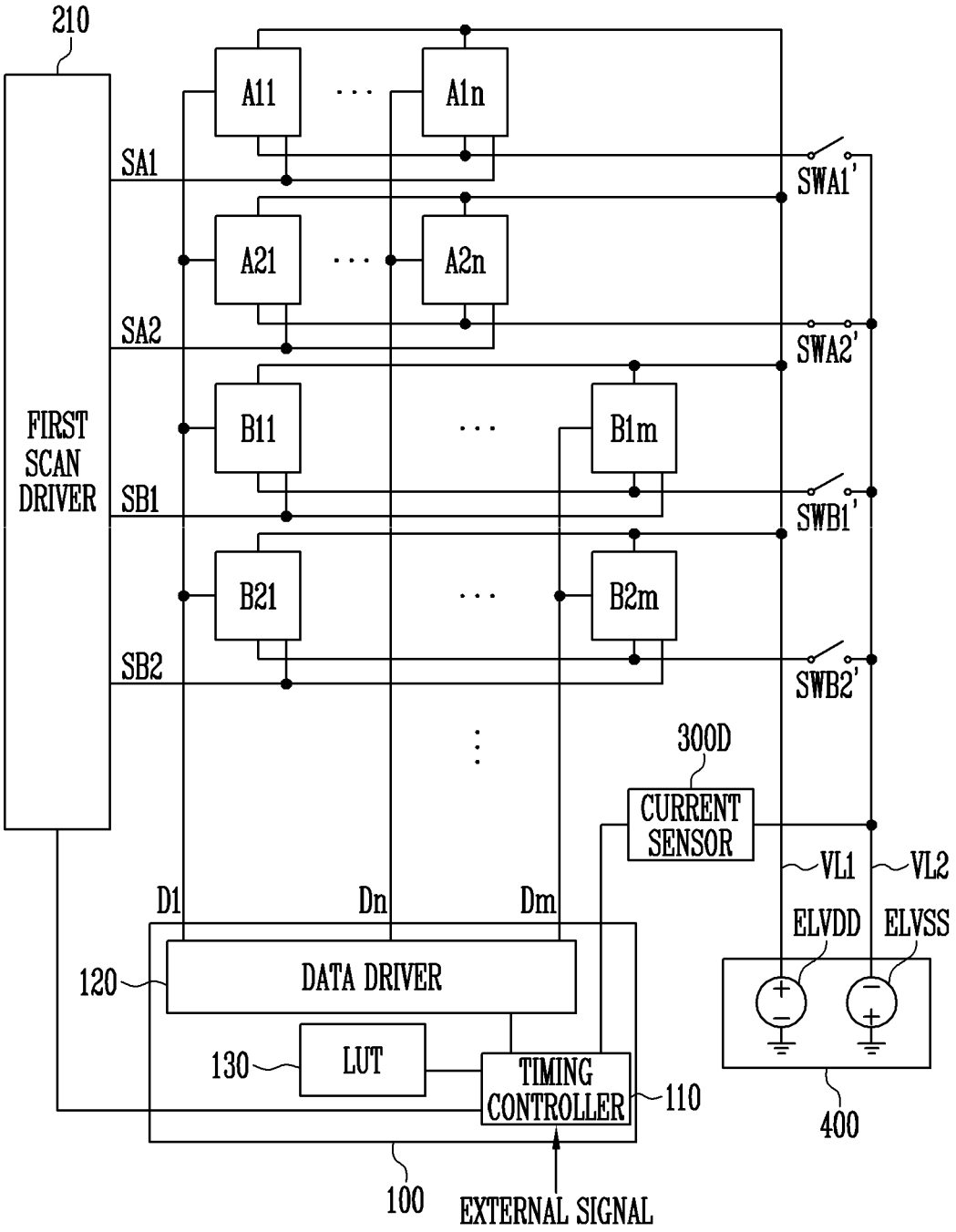
FIG. 6 is a diagram illustrating a display device including a current sensor according to a fourth embodiment of the present disclosure.

FIG. 6 is a diagram illustrating the display device including a current sensor according to a fourth embodiment of the present disclosure.

The current sensor 300D of the fourth embodiment of FIG. 6 is different from the third embodiment of FIG. 5 in that a plurality of switches SWA1', SWA2', SWB1', SWB2', etc. are coupled between the second power voltage line VL2 and each pixel.

As described with reference to FIG. 4, the value of line current sensed by the current sensor 300D of FIG. 6, and the value of line current sensed by the current sensor 300C of FIG. 5, may have different polarities (or the same polarity) and have the same or substantially the same magnitude. In the fourth embodiment of FIG. 6, a compensation method in the factory phase and a driving method in the user phase (e.g., during use by an end user) may be substantially identical to those described with respect to the third embodiment of FIG. 5, and therefore, their repeated descriptions will be omitted.

Figure 7:
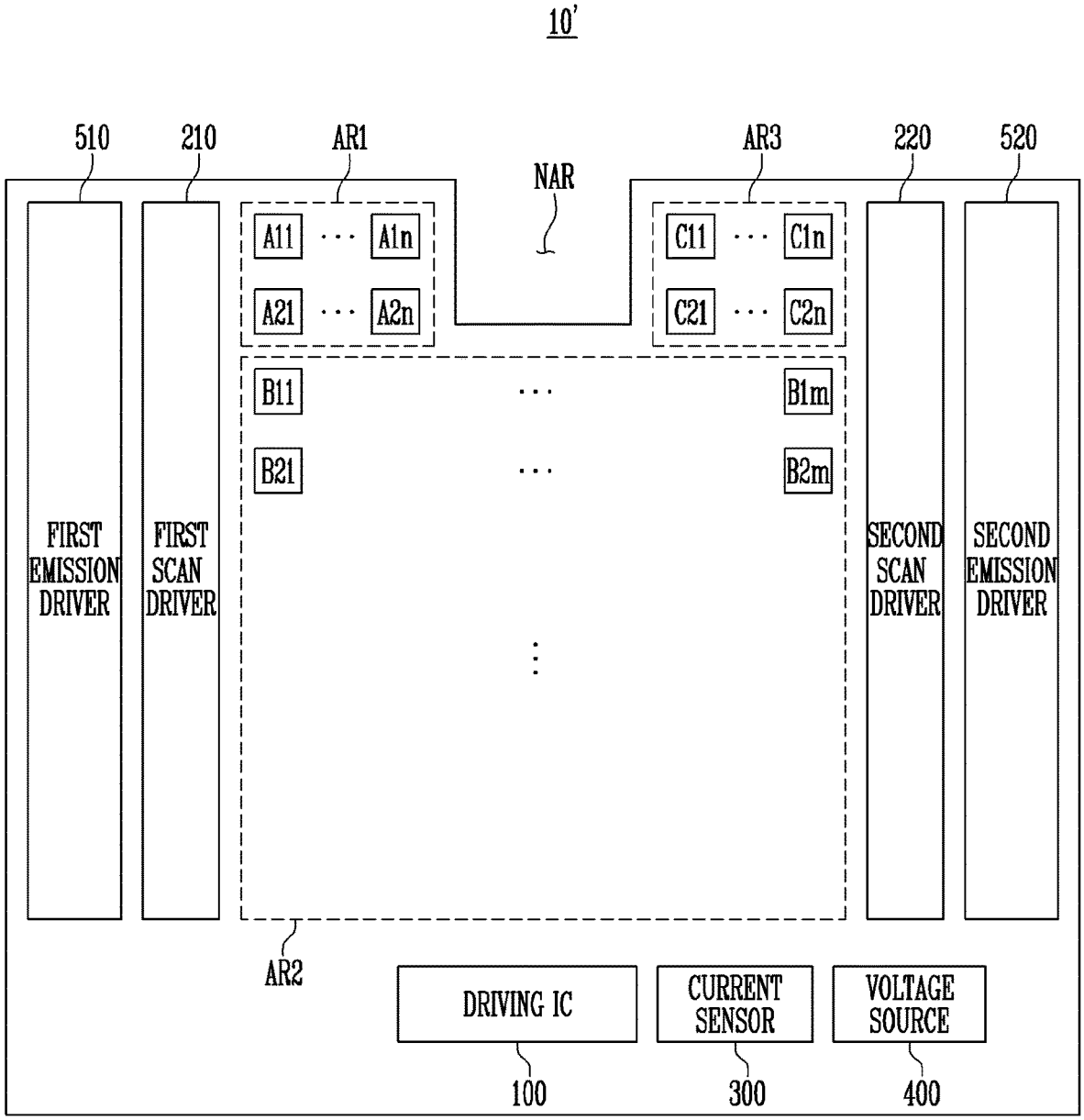
FIG. 7 is a diagram illustrating a display device according to another embodiment of the present disclosure.
Figure 8:
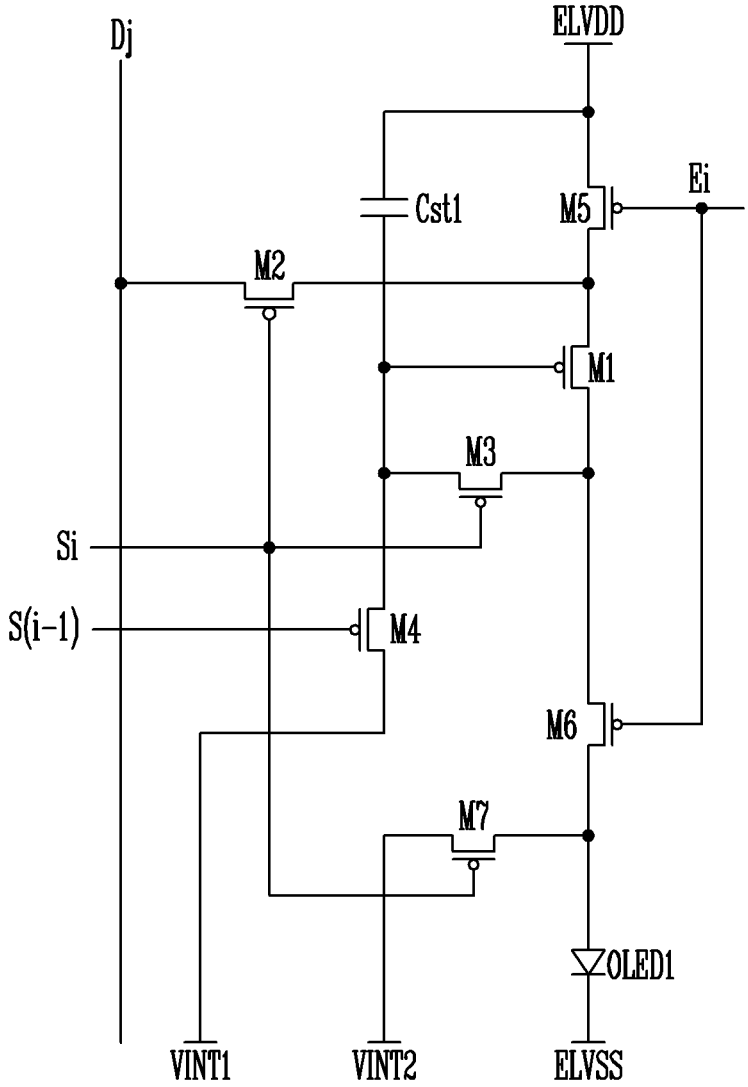
FIG. 8 is a diagram illustrating a pixel according to another embodiment of the present disclosure.

FIG. 7 is a diagram illustrating a display device according to another embodiment of the present disclosure. FIG. 8 is a diagram illustrating a pixel according to another embodiment of the present disclosure.

As compared with the display device 10 of FIG. 1, the display device 10' of FIG. 7 further includes a first emission driver 510 and a second emission driver 520. The other components of the display device 10' of FIG. 7 may be similar or identical to those of the display device 10 of FIG. 1, and therefore, their repeated descriptions will be omitted.

The first emission driver 510 may include a plurality of emission driving stage circuits. The plurality of emission driving stage circuits may be coupled to a plurality of emission driving lines extending to the first display area AR1 and the second display area AR2. For example, the first emission driver 510 may sequentially supply emission driving signals having a turn-off level to the first display area AR1 and the second display area AR2 (e.g., in the form of a shift register). Each of the other emission driving stage circuits from a second emission driving stage circuit of the first emission driver 510 may receive the emission driving signal having the turn-off level, which is supplied from the first emission driving stage circuit, as the scan start pulse (and/or each emission driving stage circuit after the first emission driving stage circuit may receive the emission driving signal having the turn-off level of the previous emission driving stage as the scan start pulse), and supply the emission driving signal having the turn-off level to a corresponding emission driving line under the control of the plurality of clock signals. In a pixel included in a pixel row receiving the emission driving signal having the turn-off level, a driving current path coupled to an organic light emitting diode is interrupted, and therefore, the organic light emitting diode does not emit light.

The second emission driver 520 may include a plurality of emission driving stage circuits. The plurality of emission driving stage circuits may be coupled to a plurality of emission driving lines extending to the third display area AR3 and the second display area AR2. For example, the second emission driver 520 may sequentially supply emission driving signals having the turn-off level to the third display area AR3 and the second display area AR2 (e.g., in the form of a shift register). Each of the other emission driving stage circuits from a second emission driving stage circuit of the second emission driver 520 may receive the emission driving signal having the turn-off level, which is supplied from the first emission driving stage circuit, as the scan start pulse (and/or each emission driving stage circuit after the first emission driving stage circuit may receive the emission driving signal having the turn-off level of the previous emission driving stage as the scan start pulse), and supply the emission driving signal having the turn-off level to a corresponding emission driving line under the control of the plurality of clock signals. In a pixel included in a pixel row receiving the emission driving signal having the turn-off level, a driving current path coupled to an organic light emitting diode is interrupted, and therefore, the organic light emitting diode does not emit light.

Referring to FIG. 8, there is illustrated an exemplary pixel that further includes transistors M5 and M6 having gate lines coupled to an emission driving line Ei.

The pixel of FIG. 8 includes a plurality of transistors M1, M2, M3, M4, M5, M6, and M7, a storage capacitor Cst1, and an organic light emitting diode OLED1.

One end of the transistor M1 is coupled to the other end of the transistor M5, the other end of the transistor M1 is coupled to one end of the transistor M6, and a gate terminal of the transistor M1 is coupled to the other end of the storage capacitor Cst1.

One end of the transistor M2 is coupled to a data line Dj, the other end of the transistor M2 is coupled to the one end of the transistor M1, and a gate terminal of the transistor M2 is coupled to a scan line Si of a current stage.

One end of the transistor M3 is coupled to the other end of the transistor M1, the other end of the transistor M3 is coupled to the gate terminal of the transistor M1, and a gate terminal of the transistor M3 is coupled to the scan line Si of the current stage.

One end of the transistor M4 is coupled to the gate terminal of the transistor M1, the other end of the transistor M4 is coupled to a first initialization voltage source VINT1, and a gate terminal of the transistor M4 is coupled to a scan line S(i−1) of a previous stage. The gate terminal of the transistor M4 may be coupled to a scan line of a stage prior to the previous stage, instead of the scan line S(i−1) of the previous scan line, or be coupled to a dedicated initialization line. That is, various coupling relationships may exist according to modifications of the present embodiment.

One end of the transistor M5 is coupled to a first power voltage source ELVDD, the other end of the transistor M5 is coupled to the one end of the transistor M1, and a gate terminal of the transistor M5 is coupled to the emission driving line Ei.

The one end of the transistor M6 is coupled to the other end of the transistor M1, the other end of the transistor M6 is coupled to an anode of the organic light emitting diode OLED1, and a gate terminal of the transistor M6 is coupled to the emission driving line Ei.

One end of the transistor M7 is coupled to the anode of the organic light emitting diode OLED1, the other end of the transistor M7 is coupled to a second initialization voltage source VINT2, and a gate terminal of the transistor M7 is coupled to the scan line Si of the current stage. The gate terminal of the transistor M7 may be coupled to the scan line S(i−1) of the previous stage, instead of the scan line Si of the current stage, or be coupled to a dedicated initialization line. That is, various coupling relationships may exist according to modifications of the present embodiment.

One end of the storage capacitor Cst1 is coupled to the first power voltage source ELVDD, and the other end of the storage capacitor Cst1 is coupled to the gate terminal of the transistor M1.

The anode of the organic light emitting diode OLED1 is coupled to the one end of the transistor M7, and a cathode of the organic light emitting diode OLED1 is coupled to a second power voltage source ELVSS. In another embodiment, the organic light emitting diode OLED1 may be formed at another position on a driving current path between the first power voltage source ELVDD and the second power voltage source ELVSS.

Hereinafter, a driving method of the pixel of FIG. 8 will be described.

If a scan signal of the previous stage, which has the turn-on level, is supplied through the scan line S(i−1) of the previous stage, the transistor M4 is turned on, and the charge at the gate terminal of the transistor M1 is initialized. Next, if a scan signal of the current stage, which has the turn-on level, is supplied through the scan line Si of the current stage, the transistors M2 and M3 are turned on, a difference in potential between voltages (e.g., data voltages) applied to the first power voltage source ELVDD and the data line Dj is recorded in the storage capacitor Cst1. At this time, since the transistor M7 is turned on, the charge at the anode of the organic light emitting diode OLED1 is initialized. In the above-described phases, an emission driving signal having the turn-off level has been supplied through the emission driving line Ei, and hence the transistors M5 and M6 are in a turn-off state. Since the driving current path of the organic light emitting diode OLED1 is interrupted, the organic light emitting diode OLED1 does not emit light. Next, if an emission driving signal having the turn-on level is supplied, the transistors M5 and M6 are in a turn-on state, a driving current flows through the organic light emitting diode OLED1, and the organic light emitting diode OLED1 emits light. At this time, the gray scale of light emitted from the organic light emitting diode OLED1 is determined by the turned-on transistor, corresponding to the voltage recorded in the storage capacitor Cst1.

The display device 10' according to the structure of FIGS. 7 and 8 has a structure similar or substantially identical to that of the display device 10 of FIG. 1, except the first and second emission drivers 510 and 520, and therefore, the first to fourth embodiments related to FIGS. 2, 4, 5, and 6 may be applied to the display device 10'.

According to the present disclosure, the display device may be capable of compensating for a difference in luminance between pixel rows including different numbers of pixels.

The electronic or electric devices, such as the driving circuit, and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims and equivalents thereof.

What is claimed is:

1. A display device comprising:

a first pixel row comprising n pixels coupled to a first scan line;

a second pixel row comprising m pixels coupled to a second scan line;

a first power voltage source configured to supply a first power voltage to the pixels of the first pixel row and the second pixel row through a first power voltage line;

a current sensor configured to sense a value of a line current flowing between the first power voltage line and a selected pixel row among the first pixel row and the second pixel row; and a timing controller configured to calculate a converted current value of the selected pixel row, wherein n is a natural number, and m is a natural number greater than n.

2. The display device of claim 1, wherein the converted current value is calculated by dividing the value of the line current by the number of pixels included in the selected pixel row.

3. The display device of claim 1, wherein the pixels of the first pixel row and the second pixel row are coupled to the first power voltage line through a common node.

4. The display device of claim 3, further comprising a second power voltage source configured to supply a second power voltage to the pixels of the first pixel row and the second pixel row through a second power voltage line.

5. The display device of claim 4, wherein the first power voltage has a voltage value higher than that of the second power voltage.

6. The display device of claim 4, wherein the first power voltage has a voltage value lower than that of the second power voltage.

7. The display device of claim 1, wherein the pixels of the first pixel row are coupled to the first power voltage line through a first switch, and the pixels of the second pixel row are coupled to the first power voltage line through a second switch.

8. The display device of claim 7, further comprising a second power voltage source configured to supply a second power voltage to the pixels of the first pixel row and the second pixel row through a second power voltage line.

9. The display device of claim 8, wherein the first power voltage has a voltage value higher than that of the second power voltage.

10. The display device of claim 8, wherein the first power voltage has a voltage value lower than that of the second power voltage.

11. The display device of claim 3, further comprising:

a first scan driver configured to supply a scan signal through the first scan line and the second scan line; and a data driver configured to supply a test data signal to the pixels of the first pixel row and the second pixel row through a plurality of data lines, wherein the current sensor senses the value of line current flowing between the first power voltage line and a pixel row selected by the scan signal and the test data signal.

12. The display device of claim 11, wherein the timing controller calculates data signal gain values which when multiplied by the converted current values for the first and second pixel rows result in an equal value for the first pixel row and the second pixel row.

13. The display device of claim 12, further comprising a look-up table configured to record the data signal gain values.

14. The method of claim 13, wherein the timing controller provides the data driver with a compensated image signal obtained by compensating for an input image signal for each pixel row using the data signal gain values.

15. The display device of claim 7, wherein the current sensor is coupled to a closed switch among the first switch and the second switch to sense a value of line current flowing between a selected pixel row and the first power voltage line.

16. The display device of claim 15, wherein the timing controller calculates data signal gain values which when multiplied by the converted current values for the first and second pixel rows result in an equal value for the first pixel row and the second pixel row.

17. The display device of claim 16, further comprising a look-up table configured to record the data signal gain values.

18. The display device of claim 17, wherein the timing controller provides the data driver with a compensated image signal obtained by compensating for an input image signal for each pixel row using the data signal gain values.

* * * * *